US005277619A

United States Patent [19]

Yamamoto

[11] Patent Number: 5,277,619

[45] Date of Patent: Jan. 11, 1994

[54] WATERPROOF CONNECTOR

[75] Inventor: Takayuki Yamamoto, Shizuoka, Japan

[73] Assignee: Yazaki Corporation, Tokyo, Japan

[21] Appl. No.: 972,563

[22] Filed: Nov. 6, 1992

[30] Foreign Application Priority Data

Nov. 8, 1991 [JP] Japan ..... 3-91662[U]
Sep. 30, 1992 [JP] Japan ..... 4-68171[U]

[51] Int. Cl.[5] ..... H01R 13/52

[52] U.S. Cl. ..... 439/469; 439/589; 174/65 R

[58] Field of Search ..... 439/274, 275, 469, 472, 439/587, 588, 589; 174/65 R, 65 SS

[56] References Cited

U.S. PATENT DOCUMENTS

| | | | |
|---|---|---|---|
| 3,437,980 | 4/1969 | Smith | 439/469 |
| 3,725,852 | 4/1973 | Blanchet | 439/589 X |
| 4,611,872 | 9/1986 | Ito et al. | 439/587 |
| 4,776,813 | 10/1988 | Wilson et al. | 439/587 |
| 4,884,978 | 12/1989 | Inaba et al. | 439/372 X |
| 5,021,610 | 6/1991 | Roberts | 439/469 X |

FOREIGN PATENT DOCUMENTS

| | | | |
|---|---|---|---|
| 1-121275 | 8/1989 | Japan . | |
| 1-121276 | 8/1989 | Japan . | |
| 2013047 | 8/1979 | United Kingdom | 439/589 |

*Primary Examiner*—Mark Rosenbaum

*Assistant Examiner*—Peter Dungba Vo

*Attorney, Agent, or Firm*—Jacobson, Price, Holman & Stern

[57] ABSTRACT

A waterproof connector specially designed for a waterproof structure of a wire lead portion using a small-diameter wire. The connector is constituted of a connector housing having a peripheral wall and a pair of openings formed in the peripheral wall on one side thereof where the wire is led to the outside, a pair of flexible packings each supported at its one end on an edge of the corresponding one of the openings and each having at the other end a wire seal portion and a peripheral wall portion projecting in the connector housing, and a pair of holders slidingly inserted into the openings and having pressing portions for pressing the flexible packings, temporary engagement portions temporarily and normal engagement portions engageable with connector housing Alternatively, the connector is constituted of a connector housing having a peripheral wall and an opening formed in the peripheral wall on one side thereof where the wire is led to the outside, a packing accommodated in the opening and having an annular wire seal portion through which the wire is inserted, and a holder having a temporary engagement portion and a normal engagement portion engageable with the connector housing, the holder being inserted through the opening in a direction such as to flatten the wire seal portion.

8 Claims, 10 Drawing Sheets

WATERPROOF CONNECTOR

BACKGROUND OF THE INVENTION

1. Field of the Invention

This invention relates to a waterproof connector having a waterproof means at a wire lead portion connected to a terminal in a connector housing.

2. Description of the Related Art

Japanese Patent Laid-Open Hei 1-121275 discloses a waterproof technique with respect to a waterproof connector having a sealing between a connector housing and a terminal wire portion accommodated in the connector housing.

The waterproof connector of this related art and the problems of the same will be described below with reference to FIGS. 13 and 14 of the accompanying drawings.

In this waterproof connector, a terminal 4 to which a wire 3 is connected is accommodated in a terminal accommodation chamber 2 of a connector housing 1, as illustrated in a longitudinal sectional view of FIG. 13. To prevent penetration of water at the terminal 4, a rubber plug 5 is provided for sealing between an inner surface of an inlet portion of the terminal accommodation chamber 2 and the wire 3.

As shown in FIGS. 13 and 14, the rubber plug 5 is formed so as to have a tubular shape with a plurality of annular projections 6 and 7 formed in its inner and outer peripheral surfaces, respectively. When the wire 3 is inserted into the rubber plug 5, the annular projections 6 are elastically deformed to be brought into close contact with the wire 3.

When the rubber plug 5 is inserted into the terminal accommodation chamber 2 together with the terminal 4, the annular projections 7 are elastically deformed and brought into close contact with the surface of the terminal accommodation chamber 2 to close the inlet of the terminal accommodation chamber 2, thereby achieving a waterproof effect.

The inside diameter of the annular projections 6 formed in the inner peripheral surface of the tubular rubber plug 5 is smaller than the outside diameter of the wire 3, since the projections 6 tightly contact the wire 3 by being elastically deformed.

A problem therefore arises in that if the diameter of the wire 3 is small, the diameter of a mold portion for forming the annular projections 6 by defining the inside diameter thereof is excessively small, so that the mold portion can be easily broken when it receives a certain lateral pressure.

However, if the diameter of the mold portion for forming the annular projections 6 is increased, a gap, such as a gap c shown in FIG. 14, is formed between the wire 3 and the annular projections 6 of the rubber plug 5, resulting in failure to prevent penetration of water into the terminal accommodation chamber 2 of the connector housing.

SUMMARY OF THE INVENTION

An object of the present invention is to solve these problems and to provide a waterproof connector in which the gap between a small-diameter wire and a terminal accommodation chamber can be closed watertightly.

To achieve this object, according to one aspect of the present invention, there is provided a waterproof connector comprising a connector housing having a peripheral wall forming a chamber for accommodating at least one wire connected to a terminal, and at least one opening formed in the peripheral wall on one side thereof where the wire is led to the outside, at least one packing inserted into the opening, and at least one holder inserted into the opening so as to press the packing, the holder having a temporary engagement portion and a normal engagement portion engageable with the connector housing.

According to another aspect of the present invention, there is provided a waterproof connector comprising a connector housing having a peripheral wall forming a chamber for accommodating at least a wire connected to a terminal, and a pair of openings formed in the peripheral wall on one side thereof where the wire is led to the outside, a pair of flexible packings each supported at its one end on an edge of the corresponding one of the openings and each having at the other end a wire seal portion and a peripheral wall portion projecting in the connector housing, and a pair of holders slidingly inserted into the openings and having pressing portions for pressing the flexible packings, temporary engagement portions temporarily engageable with the connector housing to set the pair of flexible packings in an open state of allowing insertion of the wire, and normal engagement portions engageable with connector housing with the pressing movement of the pressing portions whereby the pair of flexible packings are bent and deformed in a closing direction so that the wire seal portions are brought into close contact with each other and so that the peripheral wall seal portions are also brought into close contact with an inner surface of the peripheral wall.

In the thus-constructed waterproof connector, when the packing holders are in a temporary engagement position, the pair of flexible packings are not pressed by the packing holders, and they are in the open state allowing insertion of the wire between the pair of wire seal portions.

From this state, as the packing holders are moved and fixed in the normal engagement position, the flexible packings are pressed by the packing holders to be bent and deformed so that the wire seal portions on the opposite sides of the wire are brought into close contact with each other to seal the wire watertightly, and so that the peripheral seal portions are also brought into close contact with the inner surface of the peripheral wall. Thus, the gap between the terminal accommodation chamber and the wire is closed watertightly.

According to still another aspect of the present invention, there is provided a waterproof connector comprising a connector housing having a peripheral wall forming a chamber for accommodating at least one wire connected to a terminal, and at least one opening formed in the peripheral wall on one side thereof where the wire is led to the outside, a packing accommodated in the opening and having an annular wire seal portion through which the wire is inserted, and a holder having a temporary engagement portion and a normal engagement portion engageable with the connector housing, the holder being inserted through the opening in a direction such as to flatten the wire seal portion.

In the thus-constructed waterproof connector, the wire (a terminal with wire) is also inserted into the annular wire seal portion when the holder is in a temporarily engaged state. Then, with the movement of the holder to a normally engaged position, the wire seal portion is flattened by the holder so that the inner surface of the wire seal portion is brought into close contact with the wire, while the outer surface of the wire seal portion is brought into close contact with the housing peripheral wall inner surface and the holder outer surface, thereby closing the wire lead portion watertightly.

These and other objects and features of the present invention will become apparent from the following detailed description of the preferred embodiments of the invention taken in conjunction with the accompanying drawings.

DESCRIPTION OF THE PREFERRED EMBODIMENTS

Figure 1:
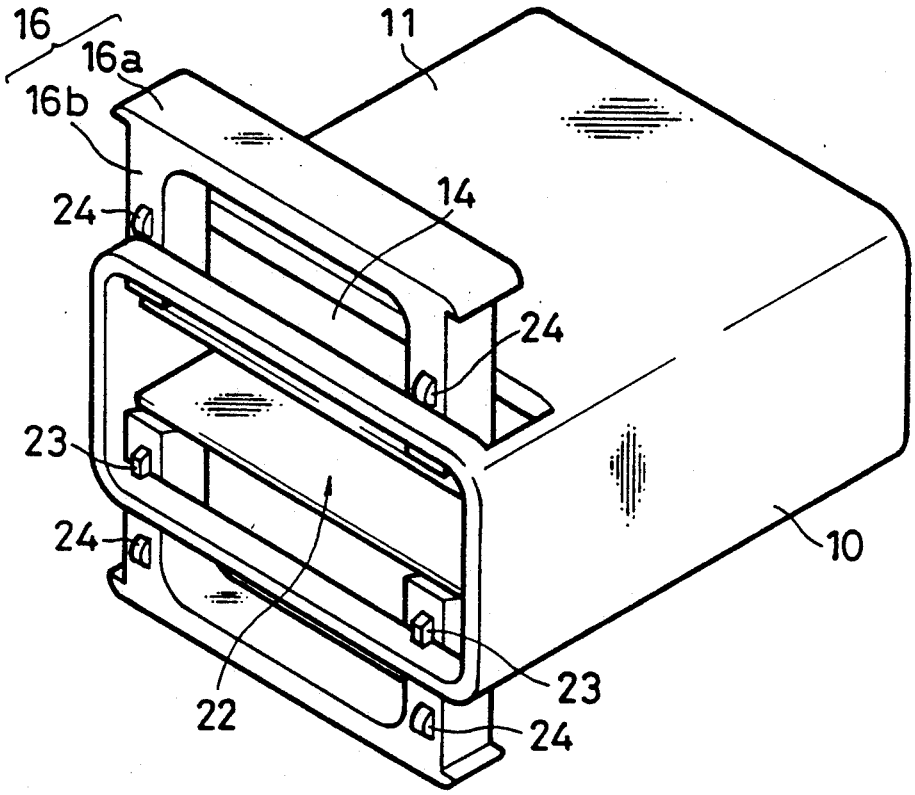
FIG. 1 is a perspective view of a waterproof connector in accordance with a first embodiment of the present invention.
Figure 2:
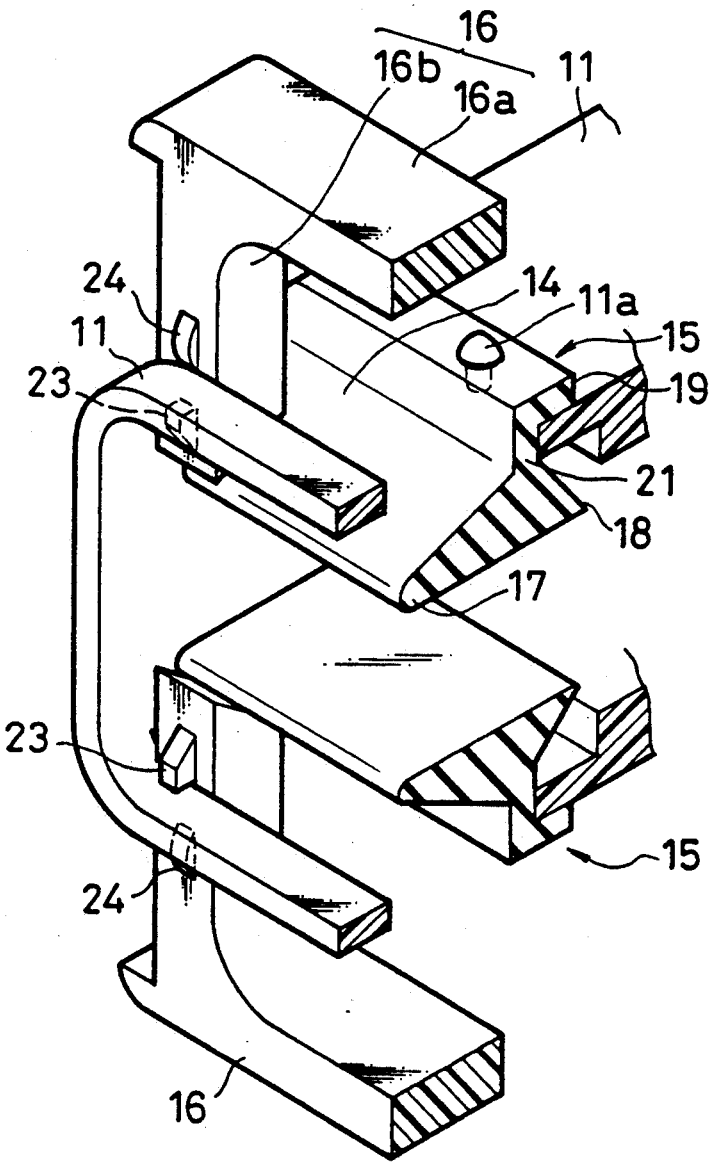
FIG. 2 is a longitudinal sectional perspective view of an essential portion of the waterproof connector shown in FIG. 1, showing the relationship between flexible packings and packing holders.

An embodiment of the present invention will be described below with reference to the accompanying drawings. FIG. 1 is a perspective view of a waterproof connector, FIG. 2 is a longitudinal sectional perspective view of an essential portion of the waterproof connector, showing the relationship between a flexible packing and a packing holder, and FIGS. 3A to 3D are longitudinal sectional views of the waterproof connector. As shown in FIG. 1, a terminal insertion hole 22 through which terminals 4 are inserted into a terminal accommodation chamber 12 (see FIG. 3A) is formed in a rear portion of a connector housing 10, and a pair of upper and lower packing support openings 14 having wall surfaces **14*a* are formed in a peripheral wall 11 forming the terminal accommodation chamber 12 in positions close to the terminal insertion hole 22**.

A flexible packing 15 and a packing holder 16 are inserted into each support opening 14 (see FIG. 2).

Two engagement projections **11*a* are formed on the surface of the peripheral wall 11 (only a head portion of one of the engagement projections 11*a* formed at the top thereof is seen in FIG. 2). Each flexible packing 15 has a base portion 19 having engagement holes 20 in which the engagement projections 11*a* are inserted for engagement, a bent connection portion 21 extended from the base portion 19 while being bent, a wire seal portion 17 bent in one direction from an end of the bent connection portion 21 and reduced in thickness toward its extreme end, and a peripheral wall seal portion 18 extending in a direction generally opposite to the direction in which the wire seal portion 17** extends.

Each flexible packing 15 is mounted in the peripheral wall 11 by inserting the bent connection portion 21 into the packing support opening 14 so that the engagement pins **11*a* are engaged with the engagement holes 20. The flexible packing 15 is thereby mounted in contact with one wall surface 14*a* of the packing support opening 14**.

The bent connection portion 21 has a small thickness such as to be easily bent, so that the wire seal portion 17 and the peripheral wall seal portion 18 can be rotatingly moved on the bent connection portion 21.

In this state, the packing holder 16 is inserted into the packing support opening 14 between the bent connection portion 21 and the other wall surface **14*b* of the packing support opening 14. The packing holder 16 is formed of an operating plate portion 16*a* and packing pressing portions 16*b* extending downward from opposite end portions of the operating plate portion 16*a*. On each packing pressing portion 16*b* are provided a temporary engagement portion 23 engageable with the peripheral wall when the packing holder 16 is set to a temporary engagement position by being inserted to a smaller extent, and a normal engagement portion 24 engageable with the peripheral wall 11 when the packing holder 16** is set to a normal engagement position by being inserted to a larger extent.

When each packing holder 16 is inserted to that the temporary engagement portion 23 is engaged with the peripheral wall 11, the pair of packing pressing portions **16*b* of the packing holder 16 at temporary engagement position are at a distance from the wire seal portion 17, the pair of flexible packings 15 are in an open state such that the wire 3 can be freely inserted therebetween, and the peripheral wall seal portion 18 is not in contact with the inner surface of the peripheral wall 11**.

However, when the normal engagement portion 24 is engaged with the peripheral wall 11, the packing pressing portion **16*b* moved to the normal engagement position presses the wire seal portion 17, and the flexible packing 15 is thereby deformed and bent on the bent connection portion 21 so that the wire seal portion 17 is brought into close contact with the wire 3 and the opposed wire seal portion 17 while the peripheral wall seal portion 18 is brought into close contact with the inner surface of the peripheral wall 11**.

The function of the thus-constructed waterproof connector will be described below with reference to FIGS. 3A to 3D and FIGS. 4A to 4B.

Figure 3A:
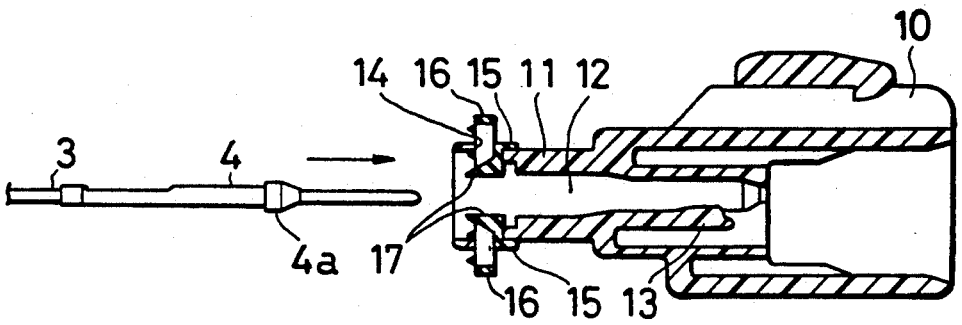
FIG. 3A is a longitudinal sectional view of a state of the waterproof connector in which the packing holders are temporarily engaged with a peripheral wall of a terminal accommodation chamber of the connector housing before a wire with a terminal is accommodated in the terminal accommodation chamber.

In the state shown in FIG. 3A, the packing holders 16 are in the temporary engagement position with the temporary engagement portions 23 engaged with the peripheral wall 11. In this state, the extreme ends of the packing pressing portions **16*b* are at a distance from the wire seal portions 17 of the flexible packings 15, the pair of flexible packings 15 are in the open state allowing insertion of the terminal 4 and the wire 3, and opposite side surfaces of the flexible packings 15 are not in contact with taper walls 25** (see FIG. 4A).

Figure 3B:
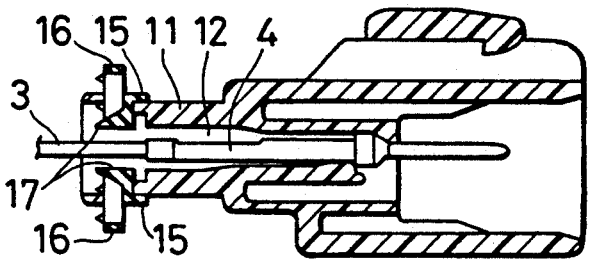
FIG. 3B is a diagram showing a state in which the terminal is accommodated in the terminal accommodation chamber.
Figure 3C:
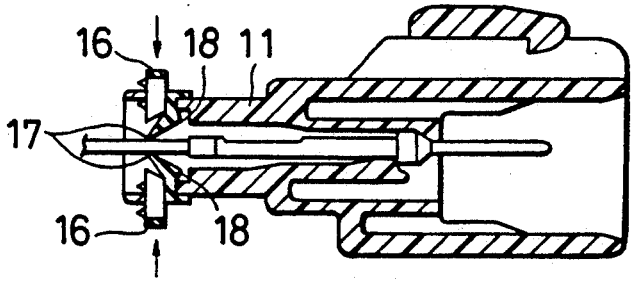
FIG. 3C is a diagram showing a state in which the packings are further pressed by the packing holders.
Figure 3D:
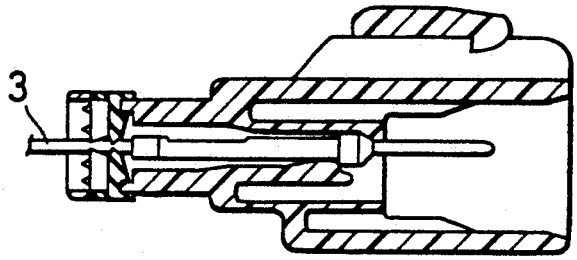
FIG. 3D is a diagram showing a state in which the packing holders are normally engaged with the peripheral wall.

In this state, the terminal 4 with the wire 3 is inserted into the terminal accommodation chamber 12 so that an engagement portion **4*a* provided on the terminal 4 is brought into engagement with a flexible arm 13 provided in the terminal accommodation chamber 12 (FIG. 3B). The operating plate portions 16*a* are then pressed and the packing holders 16 are thereby slid in a direction such as to be inserted to a position inside the peripheral wall 11 so that the extreme ends of the packing pressing portions 16*b* of the packing holders 16 press and move the wire seal portions 17 of the flexible packings 15. The flexible packings 15 are thereby bent and rotated on the thin bent connection portions 21, so that the wire seal portions 17 of the two flexible packings 15 are elastically deformed to contact the wired 3** and contact each other (see FIG. 3C).

The packing holders 16 are further inserted to bring the normal engagement portions 24 into engagement with the peripheral wall 11. The packing pressing portions **16*b* of the packing holders 16 fixed at the normal engagement position further press the wire seal portions 17 so that the wire seal portions 17 completely seal the periphery of the wire 3, and so that the peripheral wall seal portions 18 are brought into close contact with the upper and lower inner wall surfaces of the peripheral wall 11** (see FIG. 3D).

Figure 4A:
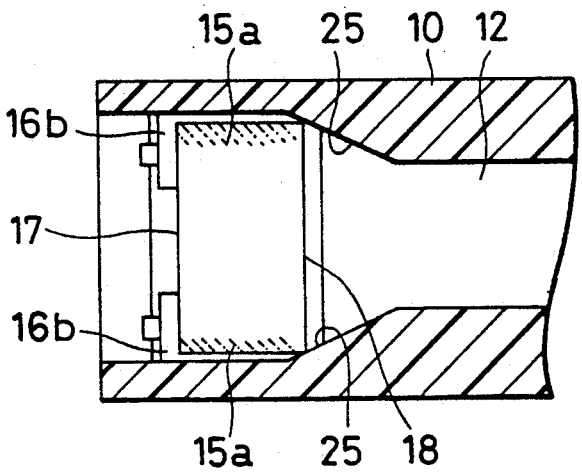
FIG. 4A is a transverse sectional view of an essential portion of the waterproof connector corresponding to FIG. 3A.
Figure 4B:
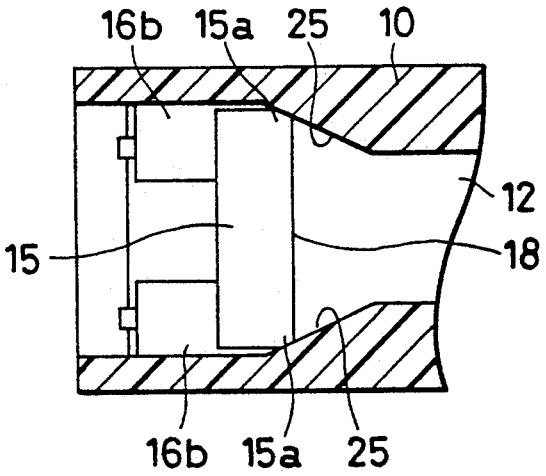
FIG. 4B is a transverse sectional view corresponding to FIG. 3D.
Figure 5:
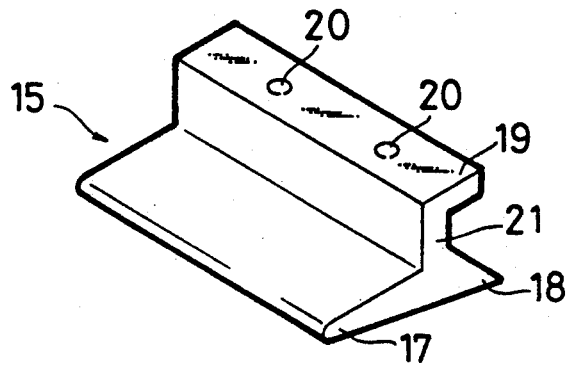
FIG. 5 is a perspective view of each flexible packing.
Figure 6:
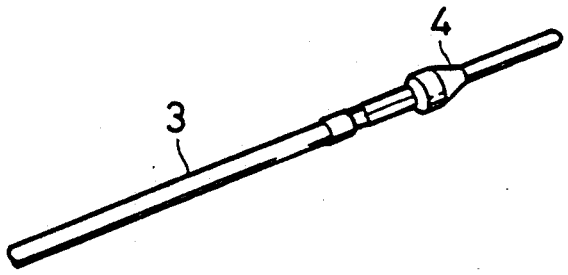
FIG. 6 is a perspective view of a terminal with wire.

Also, the side surfaces **15*a* of the extreme end portions of the flexible packings 15 are brought into close contact with the taper walls 25 by being elastically deformed (see FIG. 4B). The terminal accommodation chamber 12** is thereby closed completely along its whole inner wall surface.

Figure 7:
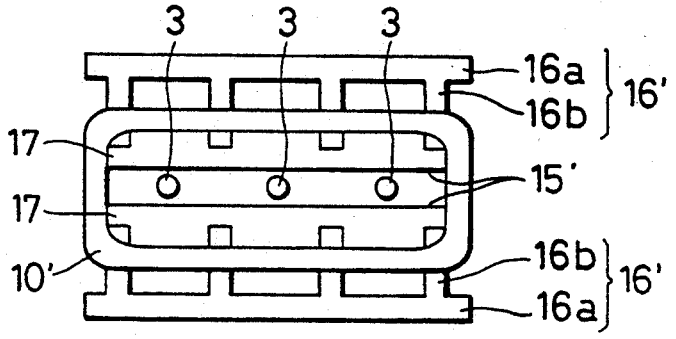
FIG. 7 is a side view of a waterproof connector for a plurality of wires in a temporarily engaged state viewed in the inlet side of a terminal accommodation chamber.

In the above-described embodiment, the connector housing is arranged in which only one terminal 4 with wire 3 is inserted into the terminal accommodation chamber 12. To enable insertion of a plurality of terminals 4 with wires 3, a waterproof connector, such as that shown in FIG. 7, is used, in which a connector housing 10' having a terminal accommodation chamber 12 for accommodating a plurality of terminals 4 with wires 3 is closed watertightly.

In this waterproof connector, packing support openings 14 having a large width such as to extend to opposite side wall inner surfaces of a peripheral wall 11 of the connector housing 10' are formed in upper and lower portions of the peripheral wall 11. Flexible packings 15' which are inserted into the packing support openings 14 and having end portions supported on the peripheral wall 11 have a width such as to be capable of contacting the opposite side wall inner surfaces of the peripheral wall 11. Packing holders 16' which are also inserted into the packing support openings 14 have operating plate portions **16*a* on which a multiplicity of packing pressing portions 16*b* are provided. A temporary engagement portion 23 and a normal engagement portion 24 are provided on each packing pressing portions 16*b***.

Figure 8:
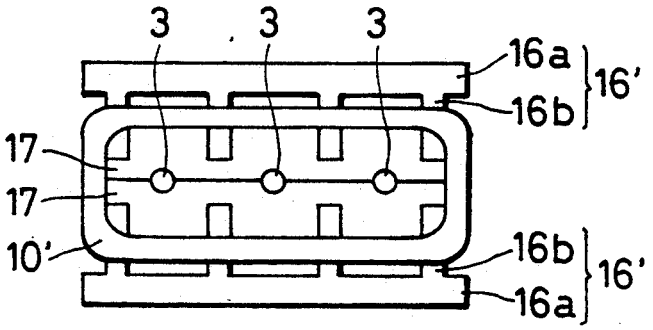
FIG. 8 is a side view of the waterproof connector for a plurality of wires in a normally engaged state viewed in the inlet side of the terminal accommodation chamber.

Each adjacent pair of the packing pressing portions **16*b* are positioned on the opposite sides of the corresponding one of the wires 3. The packing pressing portions 16*b* do not press and move the wire seal portions 17 of the flexible packings 15' at a temporary engagement position at which the temporary engagement portions 23 are engaged but press and move the wire seal portions 17 at a normal engagement position so that the wire seal portions 17 seal the wires 3 and so that the flexible packings 15' seal the peripheral wall 11** (see FIG. 8).

Thus, the connector housing 10' in which a plurality of wires 3 are accommodated is made waterproof in the same manner as the connector housing 10 in which only one wire 3 is accommodated.

Figure 9:
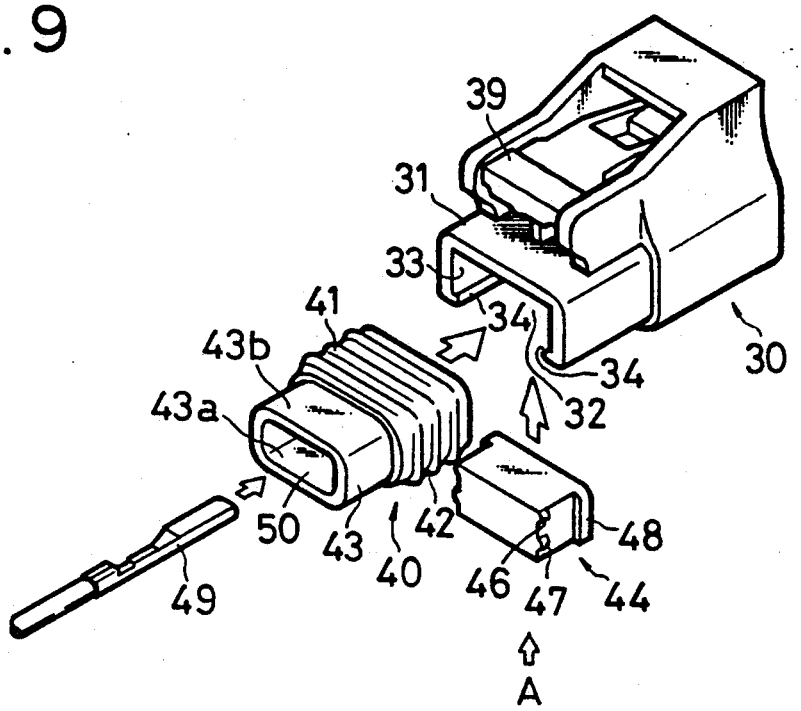
FIG. 9 is an exploded perspective view of a waterproof connector in accordance with a second embodiment of the present invention.
Figure 10:
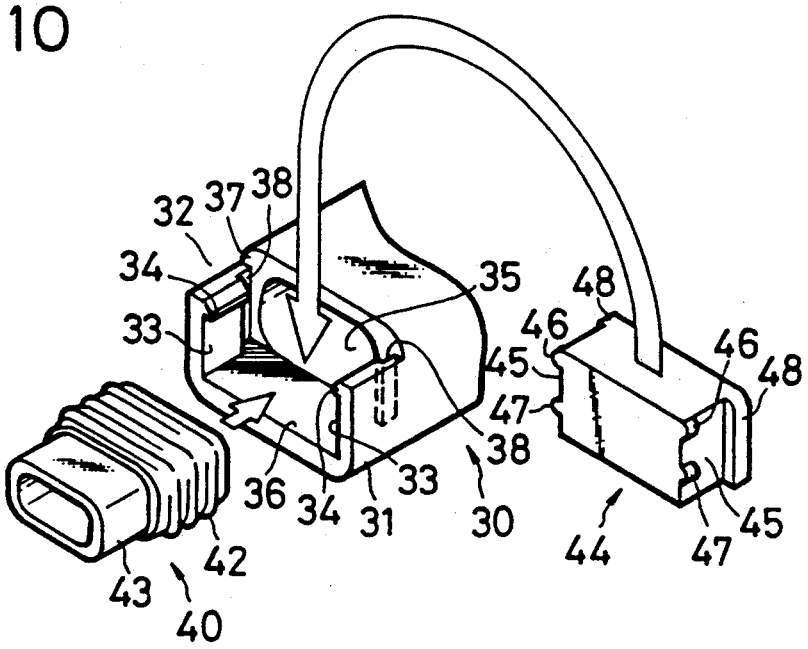
FIG. 10 is a perspective view in the direction of arrow A of FIG. 9 (viewed from under)

FIGS. 9 and 10 show a second embodiment of the present invention. FIG. 9 is an exploded perspective view of a waterproof connector, and FIG. 10 is a perspective view in the direction of arrow A of FIG. 9 (seen from under).

As shown in FIGS. 9 and 10, an opening 32 is formed as a cutout in a rear (wire leading side) bottom portion of a peripheral wall 31 of a connector housing 30 formed of a synthetic resin, and a pair of opposed engagement claws 34 are provided on end edges of two inner side walls 33 facing the opening 32. A large-diameter generally-elliptical stepped hole 35 adjacent to a terminal accommodation chamber (indicated by 51 in FIG. 11) and a terminal insertion opening 36 are provided on the front and rear sides of the opening 32. A pair of opposed guide grooves 38 having a rectangular cross section are formed in the two inner walls 33 so as to extend upright along an opening wall 37 of the stepped hole 35. A portion 39 shown in FIG. 9 is a flexible lock arm engageable with a mating connector (not shown).

A generally-elliptical annular packing 40 formed of a synthetic resin is inserted into the opening 32 from the rear side in the terminal insertion direction. The packing 40 is formed of a peripheral wall seal portion 42 having lips 41 projecting on the periphery, and a generally-elliptical annular wire seal portion 43 smaller in diameter than the peripheral wall seal portion 42 and having smooth inner and outer peripheral surfaces **43*a* and 43*b*. The wire seal portion 43 is flexible and can be easily deformed in a flattening direction by being bent. The peripheral wall seal portion 42 is press-fitted in the stepped hole 35 and the wire seal portion 43 is accommodated in the opening 32**.

Further, a holder 44 formed of a synthetic resin is inserted through the opening 32 in the direction of the arrow shown in FIG. 9. The holder 44 is formed into the shape of a generally rectangular block and has two side walls 45. A pair of temporary engagement portions (projections) 46 and normal engagement portions (projections) 47 engageable with the engagement claws 34 of the connector housing 30 are arranged on rear portions of the side walls 45, and a pair of elongated slide projections 48 engageable with the guide grooves 38 are provided on front portions of the side walls 45.

Figure 11A:
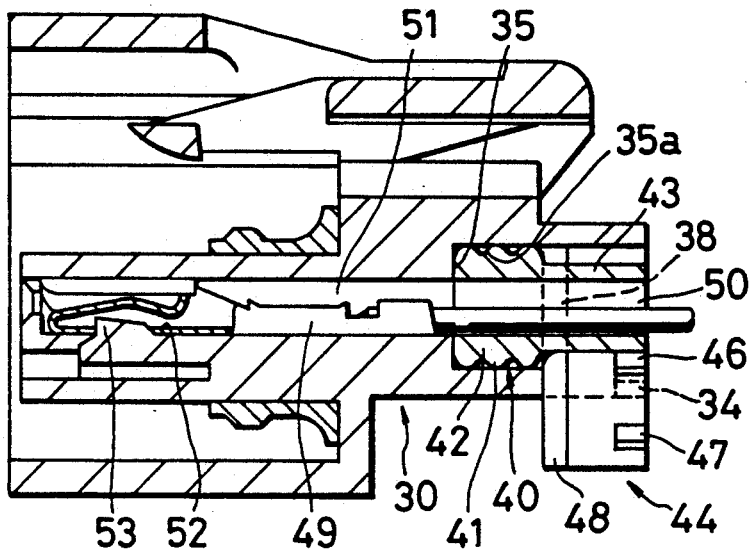
FIG. 11A is a longitudinal sectional view of the connector shown in FIG. 9, showing a temporarily engaged state of a holder.
Figure 12A:
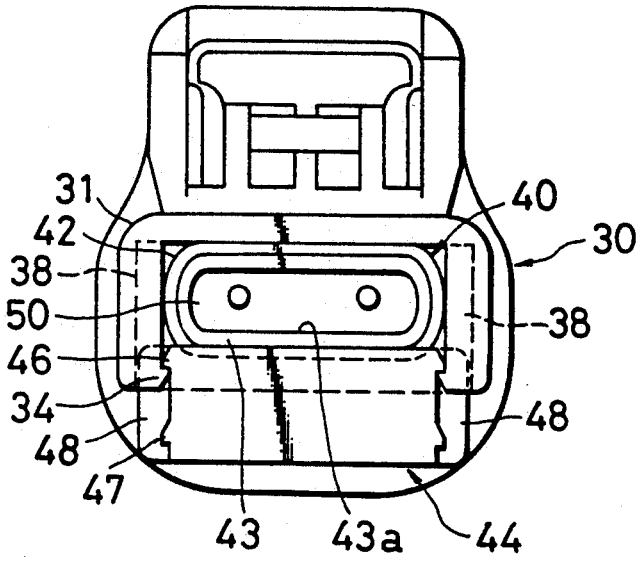
FIG. 12A is a rear view of the connector shown in FIG. 9, showing the temporarily engaged state of the holder.

As shown in the longitudinal sectional view of FIG. 11A and the rear view of FIG. 12A, the packing 40 is fitted in the connector housing 30, and the holder 44 is inserted along the guide grooves 38 to be temporarily stopped (with the temporary engagement portions 46 engaged with the engagement claws 34). In this state, terminals 49 with wires are inserted into the terminal accommodation chamber 51 through an inner hole (through hole) 50 of the packing 40. The terminals 49 are fixed by bringing front engagement holes 52 into engagement with engagement lances 53 of the connector housing 30. The peripheral lips 41 on the peripheral wall seal portion 42 of the packing 40 are brought into close contact with an inner surface 35*a* of the stepped hole 35, thereby making the connector waterproof.

Figure 11B:
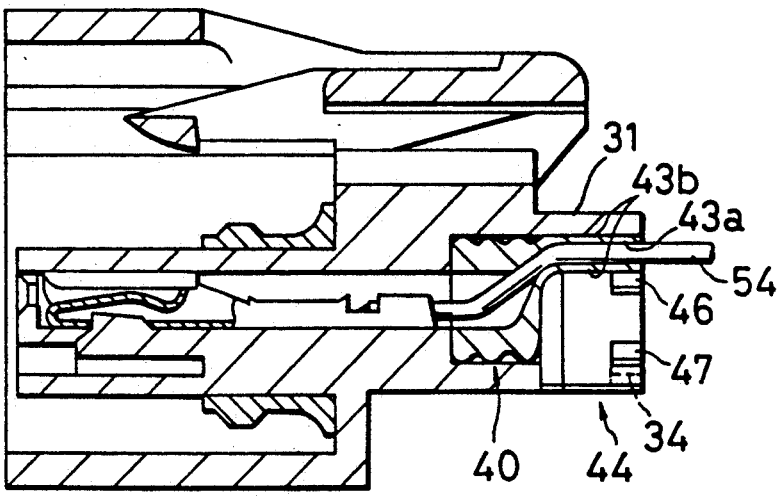
FIG. 11B is a is a longitudinal sectional view of the connector shown in FIG. 9, showing a normally engaged state of the holder (waterproof state)
Figure 12B:
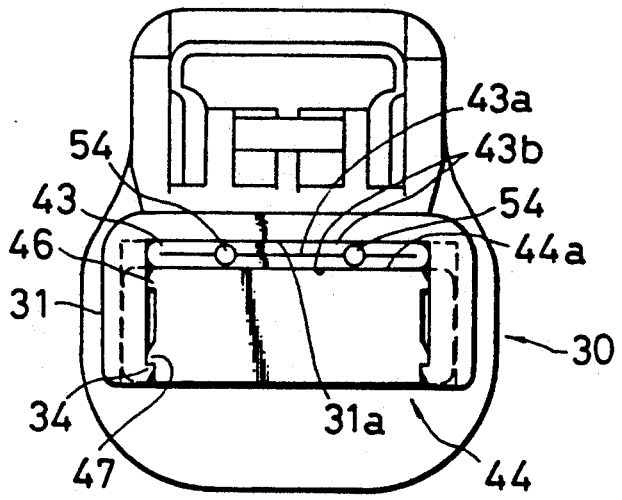
FIG. 12B is a rear view of the connector shown in FIG. 9, showing the normally engaged state of the holder.
Figure 13:
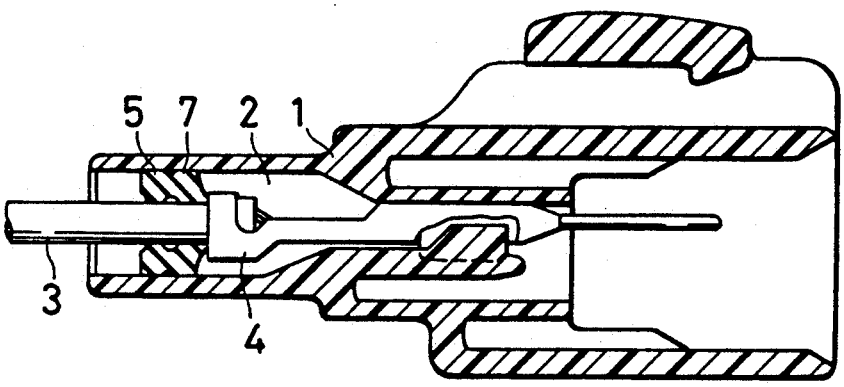
FIG. 13 PRIOR ART
FIG. 13 is a longitudinal sectional view of a conventional waterproof connector using a rubber plug.
Figure 14:
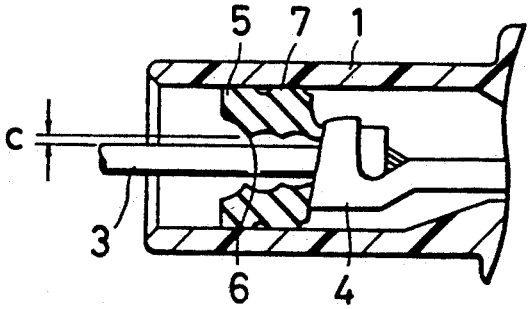
FIG. 14 PRIOR ART
FIG. 14 is a longitudinal sectional view of an essential portion of the conventional waterproof connector, showing a gap formed between a small-diameter wire and the rubber plug.

Further, as shown in FIGS. 11B and 12B, the holder 44 is forced upward for normal engagement (to engage the normal engagement portions 47 with the engagement claws 34). The wire seal portion 43 of the packing 40 is thereby flattened so that upper and lower portions of the inner circumferential surface 43*a* are brought into close contact with each other with wires 54 pinched therebetween. The wires 54 are maintained in a state of being embedded in soft wire seal portion 43 and tightly contacting the same, thereby preventing penetration of water along the wires 54. Simultaneously, the outer surface 43*b* of the wire seal portion 43 tightly contact an inner surface 31*a* of the peripheral wall 31 and an upper surface 44*a* of the holder 44, thereby preventing penetration of water from the outside of the packing as well.

The above-described arrangement of the present invention in which terminals with wires can be smoothly inserted into the connector housing, and in which the packing is bent by the movement of the holder, enables even small-diameter wires, which cannot be enclosed watertightly by the conventional tubular rubber plug, to be sealed with improved reliability.

In the conventional waterproof connector, if the wire diameter is small, the diameter of the corresponding mold portion is so small that the strength of the mold portion is insufficient and there is a risk of the mold portion being easily broken. This problem can be solved by using the waterproof connector of the present invention.

What is claimed is:

1. A waterproof connector comprising:

a connector housing having a peripheral wall forming a chamber for accommodating at least one wire connected to a terminal, and at least one opening formed in the peripheral wall on one side thereof where the wire extends from inside said housing to outside said housing;

at least one packing inserted into said opening; and at least one holder inserted into said opening in an inserting direction so as to press said packing, said holder having a temporary engagement portion lockable with engagement means of said connector housing in a direction opposite to said inserting direction of said holder with the wire located inside said opening and inside said housing for temporarily fixing said holder in said connector housing until said holder is moved further in said inserting direction to have a normal engagement portion of said holder lockable with said engagement means of said connector housing with the wire located inside said housing.

2. A waterproof connector comprising:

a connector housing having a peripheral wall forming a chamber for accommodating at least one wire connected to a terminal, and a pair of openings formed in the peripheral wall on one side thereof where the wire extends from inside said housing to outside said housing;

a pair of flexible packings each supported at its one end on an edge of the corresponding one of said openings and each having at the other end a wire seal portion and a peripheral wall seal portion projecting in said connector housing; and a pair of holders slidingly inserted into said openings and having pressing portions for pressing said flexible packings, temporary engagement portions temporarily engageable with said connector housing to set said pair of flexible packings in an open state of allowing insertion of the wire, and normal engagement portions engageable with connector housing with the pressing movement of said pressure portions whereby said pair of flexible packings are bent and deformed in a closing direction so that said wire seal portions are brought into close contact with each other and so that said peripheral wall seal portions are also brought into close contact with an inner surface of said peripheral wall.

3. A waterproof connector according to claim 2, wherein each of said flexible packings includes a base portion attached to said peripheral wall, and a bent connection portion extended from the base portion while being bent, the wire seal portion and the peripheral wall seal portion being formed as thin end portions extending from the bent connection portions in opposite directions.

4. A waterproof connector according to claim 2, wherein each of said packing holders includes an operating plate portion, the packing pressing portions extending from opposite ends of the operating plate portion, the temporary engagement portions and the normal engagement portions being formed on the pressing portions.

5. A waterproof connector according to claim 2, wherein A terminal accommodation tubular portion of said connector housing is formed so as to accommodate a plurality of wires connected to terminals; the openings of said connector housing have a width such as to extend to opposite side wall inner surfaces of said peripheral wall; each of said flexible packings has a width such as to be able to contact the opposite side wall inner surfaces of said peripheral wall; and a multiplicity of the packing pressing portions of said packing holders are disposed so that each pair of the packing pressing portions are located on the opposites sides of the corresponding one of the wires.

6. A waterproof connector comprising:

a connector housing having a peripheral wall forming a chamber for accommodating at least one wire connected to a terminal, and at least one opening formed in the peripheral wall on one side thereof where the wire extends from inside said housing to outside said housing;

a packing accommodated in said at least one opening and having an annular wire seal portion through which the wire is inserted; and a holder inserted towards said annular wire seal portion in an inserting direction having a temporary engagement portion lockable with engagement means of said connector housing in a direction opposite to said inserting direction of said holder for temporarily fixing said holder in said connector housing until said holder is moved further in said inserting direction to have a normal engagement portion of said holder lockable with said engagement means of said connector housing, and said holder being inserted through said at least one opening in said inserting direction such as to flatten said wire seal portion when said normal engagement portion engages said engagement means of said connector housing.

7. A waterproof connector according to claim 6, wherein said opening is formed as a cutout in a bottom side of said connector housing peripheral wall; a large-diameter stepped hole connected to said terminal accommodation chamber and a terminal insertion hole formed on a front and a rear side of said opening; and said packing is inserted into the terminal insertion direction, while said holder is inserted through said bottom cutout of said peripheral wall.

8. A waterproof connector according to claim 7, wherein said packing has a peripheral wall seal portion press-fitted in said stepped hole and having an outer dimension greater than that of an outer dimension of said wire seal portion.

* * * * *